United States Patent [19]

Karayannis et al.

[11] 4,080,869

[45] Mar. 28, 1978

[54] APPARATUS FOR GENERATING AN ELECTRICAL IGNITION CURRENT IN A FUZE OF A PROJECTILE

[75] Inventors: Panayotis Karayannis, Zurich; Klaus Münzel, Klingnau, both of Switzerland

[73] Assignee: Werkzeugmaschinenfabrik Oerlikon-Bührle AG, Zurich, Switzerland

[21] Appl. No.: 770,001

[22] Filed: Feb. 18, 1977

[30] Foreign Application Priority Data

Mar. 9, 1976 Switzerland ..... 2895/76

[51] Int. Cl.[2] ..... F42C 17/00

[52] U.S. Cl. ..... 89/6.5; 102/70.2 G

[58] Field of Search ..... 89/6.5; 102/70.2 G

[56] References Cited

U.S. PATENT DOCUMENTS 2,919,627 1/1960 Cardona et al. ..... 102/70.2 G

*Primary Examiner*—Stephen C. Bentley

*Attorney, Agent, or Firm*—Werner W. Kleeman

[57] ABSTRACT

An apparatus for generating an electrical ignition current in the fuze of a projectile to be fired from a weapon, comprising an induction coil arranged in the projectile, a magnet for generating a magnetic field, a bipartite yoke, one part of which is located at the projectile and the other part at the weapon barrel, for producing a change in the magnetic flux upon passage of the projectile through the weapon barrel. According to one embodiment the part of the yoke located at the weapon barrel comprises a number of ferromagnetic rings and paramagnetic rings arranged between the ferromagnetic rings. The part of the yoke located at the projectile body comprises a substantially cylindrical body member having a substantially disc-shaped flange for the reception of the induction coil as well as a soft iron disc. With this arrangement the magnet is a permanent magnet which is disposed between this cylindrical body member and the soft iron disc. The axis of the induction coil substantially coincides with the projectile axis, and the aforesaid ferromagnetic and paramagnetic rings are arranged at the end of the weapon barrel. It is possible, according to another embodiment, to use instead of a permanent magnet, an electromagnet located at the mouth of the weapon and containing such ferromagnetic and paramagnetic rings, with the yoke at the weapon barrel being in the form of a triple-arm yoke carrying two oppositely polarized electromagnetic coils.

6 Claims, 10 Drawing Figures

APPARATUS FOR GENERATING AN ELECTRICAL IGNITION CURRENT IN A FUZE OF A PROJECTILE

BACKGROUND OF THE INVENTION

The present invention generally relates to weapon systems, and, more specifically, concerns a new and improved construction of apparatus for generating an electrical ignition current in the fuze of a projectile which is intended to be fired from a weapon or gun. Generally speaking the apparatus of this invention is of the type comprising an induction coil located in the projectile, a magnet for generating a magnetic field, a two-part or bipartite yoke, one part of which is located at the projectile and the other part of which is located at the weapon barrel, in order to generate a change in the magnetic flux upon passage of the projectile through the weapon barrel.

According to a state-of-the-art construction of apparatus of this type, as disclosed in U.S. Pat. No. 1,739,921, an electromagnet is arranged at the mouth or muzzle of the weapon barrel and the projectile fuze possesses an induction coil. Upon passage of the induction coil through the electromagnet there is induced a current in the induction coil which, on the one hand, is employed for charging a capacitor and, on the other hand, for switching-on a mechanical timing relay.

Disadvantageous with this prior art construction is the need to arrange an electromagnet at the muzzle at the region of the hot gases, and further, with such electromagnet there can only be induced a single current surge.

Furthermore, there is known to the art from U.S. Pat. No. 3,417,700 an apparatus where a number of induction coils containing permanent magnets are uniformly distributed at the circumference or periphery of the projectile body, and the coil axes are disposed radially with regard to the projectile body. The magnetic field produced by the permanent magnets is closed as long as the projectile is located within the weapon barrel and opens as soon as the projectile departs from the weapon barrel, resulting in a voltage being induced in the induction coil.

Yet this prior art apparatus is associated with the following drawbacks:

(a) such type arrangement of the induction coils cannot be employed with small caliber ammunition;
(b) the radial acceleration in the case of spinning ammunition does not allow for any such type arrangement of the induction coil; and
(c) there can only be generated a single pulse.

SUMMARY OF THE INVENTION

Therefore, with the foregoing in mind, it is a primary object of the present invention to provide an improved construction of apparatus for generating an electrical ignition current in the fuze of a projectile in a manner not associated with the aforementioned drawbacks and limitations of the prior art proposals.

Another and more specific object of the present invention aims at the provision of an apparatus of the previously mentioned type, by means of which, during passage of the projectile through the barrel of the weapon, there can be generated as large as possible energy, and which apparatus also is suitable for use with small caliber projectiles as well as spinning ammunition or projectiles.

Now in order to implement these and still further objects of the invention, which will become more readily apparent as the description proceeds, the apparatus of this development is manifested by the features that according to one embodiment:

(a) the part of the yoke located at the weapon barrel possesses a number of ferromagnetic rings or ring members;
(b) paramagnetic rings or ring members are arranged between the ferromagnetic rings;
(c) the part of the yoke located at the projectile body comprises a substantially cylindrical body member having a substantially disc-shaped flange for the reception of the induction coil as well as a soft iron disc;
(d) the magnet in the form of a permanent magnet is arranged between this substantially cylindrical body member and the soft iron disc;
(e) the axis of the induction coil substantially coincides with the projectile axis; and
(f) the aforesaid ferromagnetic rings and paramagnetic rings are arranged at the end of the weapon barrel.

According to another embodiment of the invention, there is provided an arrangement wherein:

(a) the magnet comprises an electromagnet located at the mouth of the weapon barrel and composed of a number of ferromagnetic rings and paramagnetic rings arranged between the ferromagnetic rings;
(b) the part of the yoke at the weapon barrel comprises a three-arm yoke attached to said ferromagnetic rings;
(c) two electromagnetic coils polarized in opposite directions surround at least part of said three-arm yoke; and
(d) the axis of the induction coil substantially coincides with the axis of the projectile.

An advantageous construction of the modified embodiment comprises three such ferromagnetic rings connected to one another by two of the paramagnetic rings which are in the form of sleeves.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

At this point in the disclosure, it is mentioned that different ignition current generators for electronic projectile fuzes are known to the art, wherein both parts of the yoke are arranged in the projectile. With such type generators only the inertia forces can be utilized for generating the electrical energy.

In the case of spinning ammunition e.g. spinning projectiles, there can be employed, for instance, rotary generators wherein the rotational acceleration or a change in the moment of inertia can be utilized for generating the electrical energy. Friction forces appear between the rotor and the stator, and difficulties arise during the mounting of the rotor. Further, it is possible to use for spinning ammunition, for instance surge generators. Depending upon the construction of such surge generators the mode of operation is different. There are required different safety devices, for instance for providing the necessary safety during transport of the projectile.

In the case of fin-stabilized projectiles it is only possible to use surge generators or batteries.

Piezoelectric generators can be employed both for spinning ammunition as well as also for fin-stabilized projectiles. However, such type generators can only generate a very small amount of electrical energy per unit volume.

Figure 6:
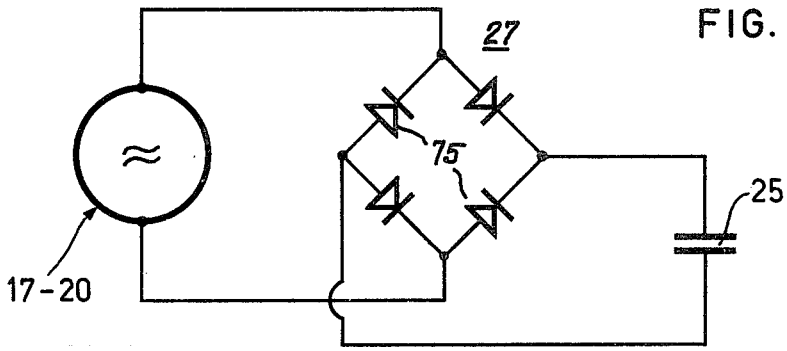
FIG. 6 schematically illustrates an exemplary embodiment of circuitry which can be used between the generator and capacitor with the apparatus of the invention.
Figure 7:
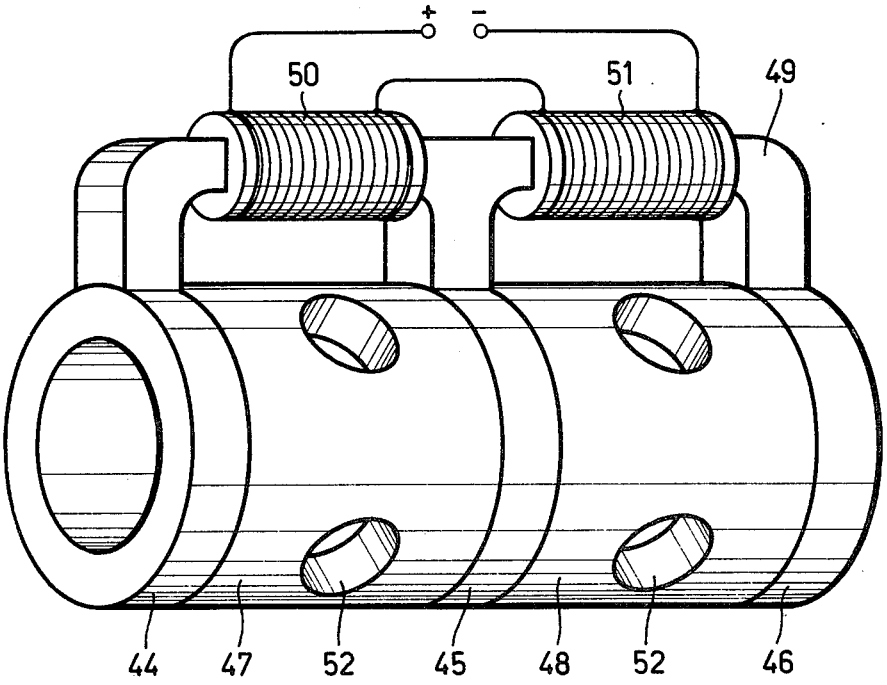
FIG. 7 is a perspective view of the front end of a weapon barrel.
Figure 9:
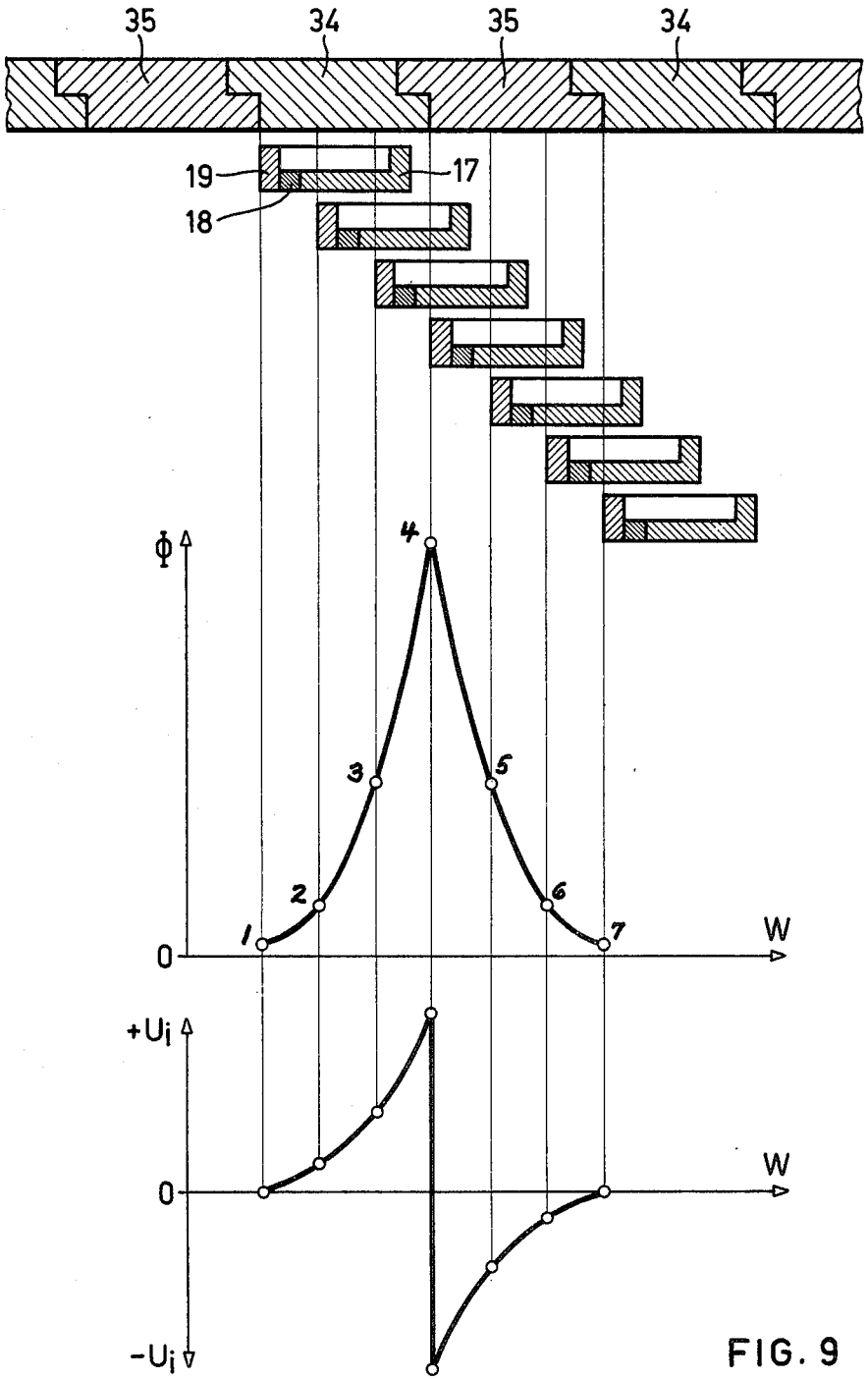
FIG. 9 is a diagram illustrating graphs of the magnetic flux and the induced voltage.
Figure 10:
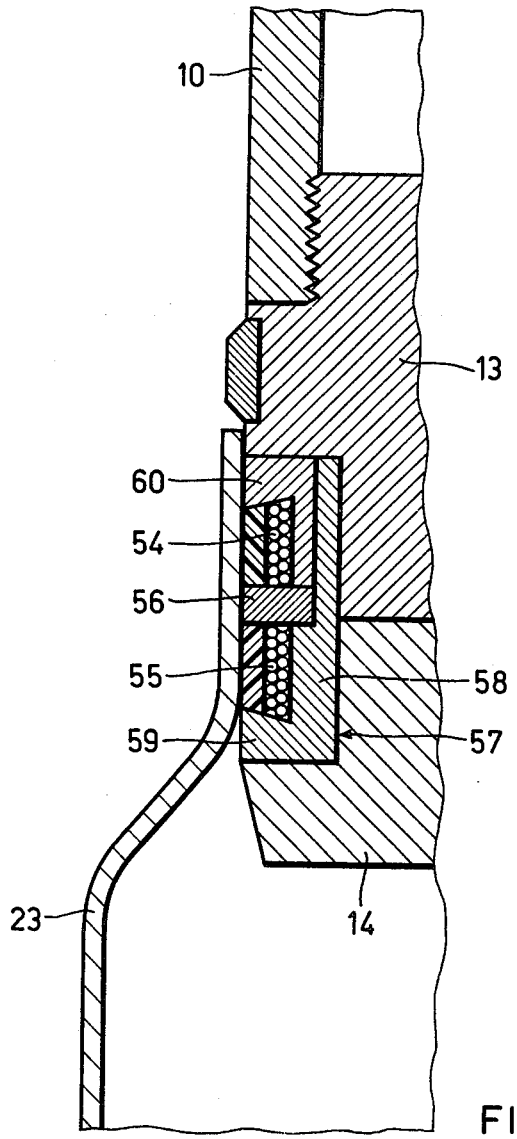
FIG. 10 is a fragmentary longitudinal sectional view through an electronic fuze arranged at the rear end of a projectile body equipped with an ignition current generator according to a fifth exemplary embodiment of the invention.

Now with the foregoing in mind the ignition current generators of the invention have been designed for the purpose of avoiding a number of such problems which are prevalent with the heretofore known prior art generators. Turning attention therefore initially to the embodiment shown in FIG. 1, it will be seen that a fuze housing 12 is attached at the rear end of a projectile body 10 which contains an explosive charge 11. This fuze housing 12 comprises a substantially pot-shaped threaded sleeve 13 and a tail screw 14 or equivalent structure which is threaded into the internal threading 15 of the sleeve 13. This sleeve 13 is also threadably connected with the internal threading 16 of the projectile body 10. Between the rear end surfaces or faces of the projectile body 10 and the sleeve 13 on the one hand, and the head 14*a* of the tail screw 14 on the other hand, there is arranged one part 17 of a yoke or equivalent structure. This yoke part 17 contains a permanent magnet ring 18 and a soft iron disc 19 as well as an induction coil 20. The induction coil 20 is surrounded by an insulating ring 21. Further, a guide ring 24 is secured to the outer periphery or circumference of the projectile body 10. Internally of the tail screw 14 there are located different components or elements of the fuze, which are not part of the subject matter of the invention and can be constructed in conventional fashion. One possible arrangement and operation of such elements, forming a fuze firing chain, has been disclosed for instance in the commonly assigned U.S. Pat. No. 3,994,228, granted Nov. 30, 1976 listing as the inventor "Walter Hürlimann", and entitled "Projectile Fuze for a Spinning Projectile Containing a Detonator Cap and an Electro-Magnetic Firing or Ignition Current Generator", to which reference may be readily had and the disclosure of which is incorporated herein by reference. Thus, in the description to follow there will only be considered enough of the structure of the elements located within the tail screw 14 to provide those skilled in the art with sufficient background information and a clear appreciation of the underlining concepts of the present invention. Hence, it will be appreciated that belonging to such elements is a charging capacitor 25 (see also FIG. 6) which can be charged by the inventive ignition current generator. Connected with the charging capacitor 25 is a detonator cap 26 which can be fired by the charge stored in the charging capacitor 25 as is well known. An electronic control element 27 ensures for the proper detonation of the detonator cap 26 at the correct moment in time. Located in front of the detonator cap 26 is a detonator or transfer element 28 which transmits the detonation or firing of the detonator cap 26 to a reinforcement charge 29. This reinforcement charge 29 is attached to the sleeve 13 and protrudes into the explosive charge 11. Further, the detonator 28 is located in a rotor 30 which can be rotated out of the illustrated armed position into a safety position. DDue to the spin of the projectile the rotor 30 moves out of the safety position into the armed or firing position.

Now as long as the projectile body 10 is located in the cartridge sleeve 23, then the cartridge sleeve 23 short-circuits the magnetic field produced by the permanent magnet 18. To ensure that the projectile can be reliably fired or exploded at the target there is also provided an impact switch 31.

Figure 1:
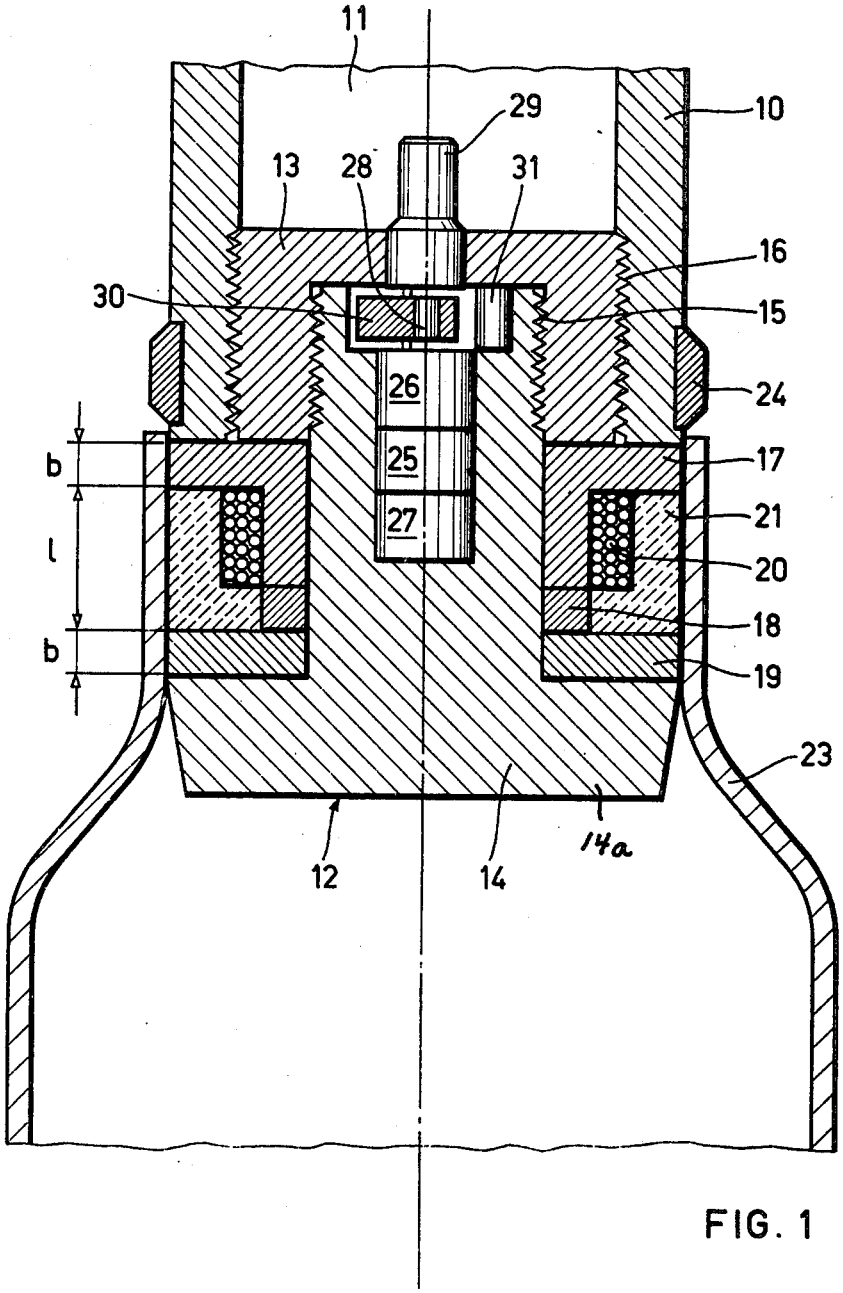
FIG. 1 is a longitudinal sectional view through an electronic projectile fuze arranged at the rear end of a projectile body equipped with a generator.
Figure 2:
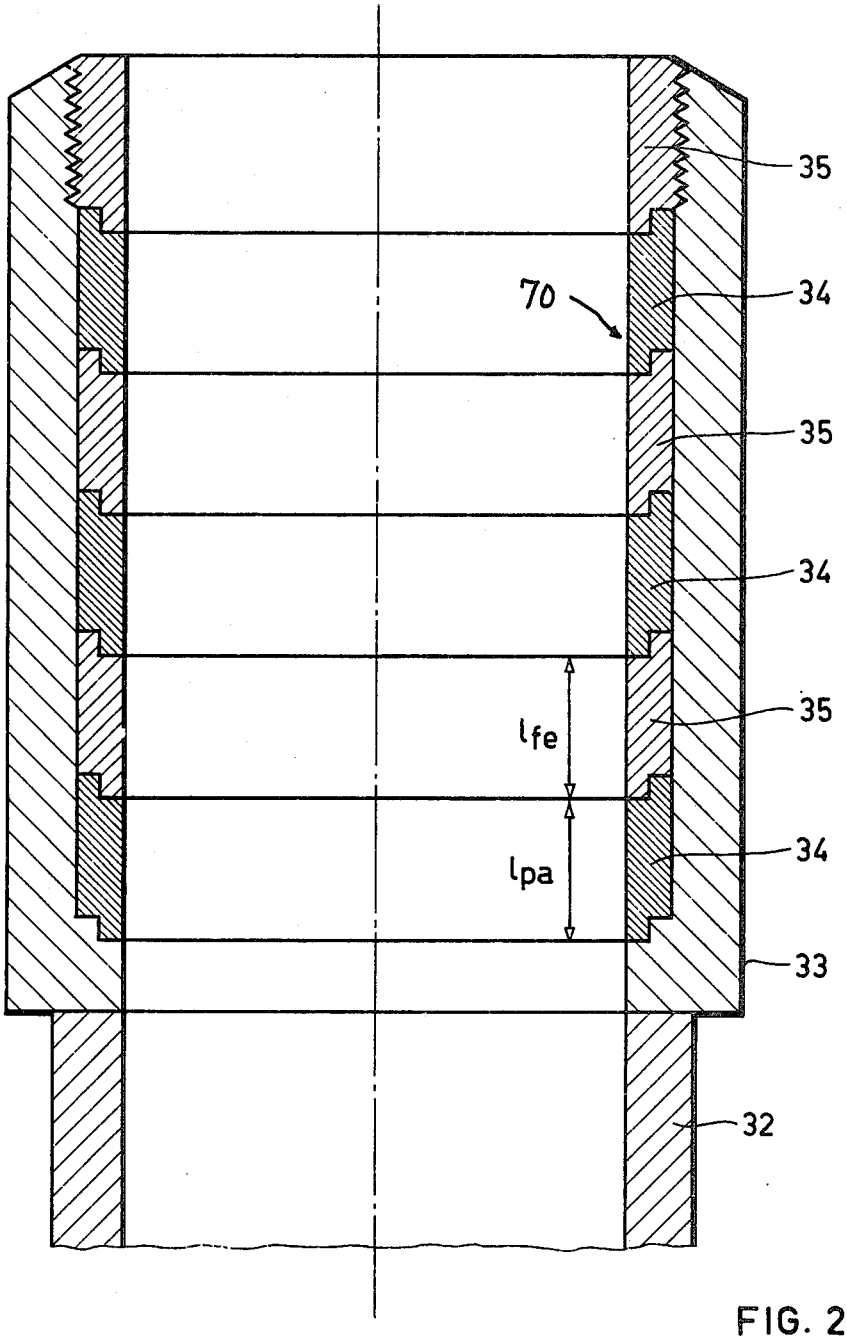
FIG. 2 is a longitudinal sectional view through the front end of a weapon barrel having a muzzle brake.
Figures 3, 8:
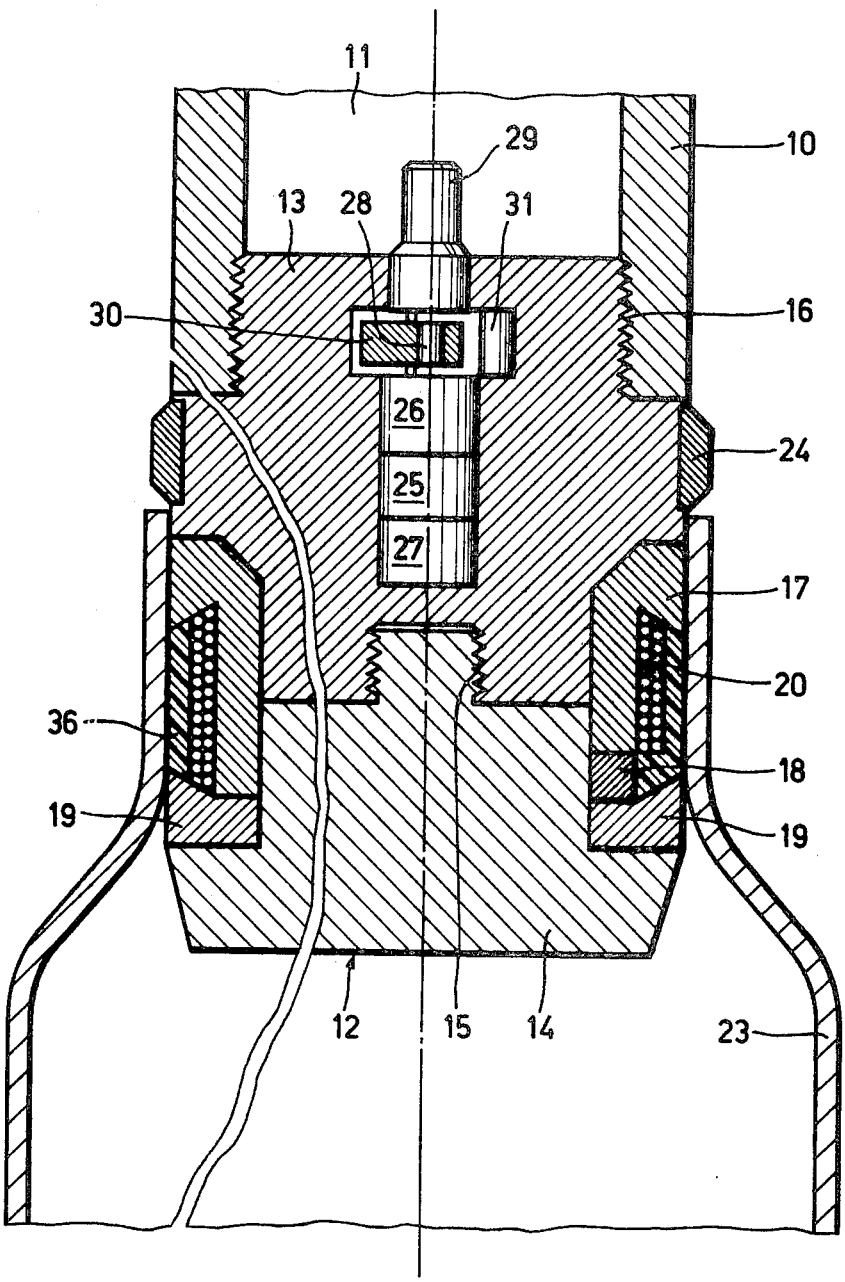
FIG. 3 is a longitudinal sectional view through a second exemplary embodiment of an electronic projectile fuze arranged at the rear end of a projectile body equipped with a generator.
FIG. 8 is a longitudinal sectional view of a fourth exemplary embodiment of an electronic fuze arranged at the rear end of a projectile body equipped with an ignition current generator.
Figure 4:
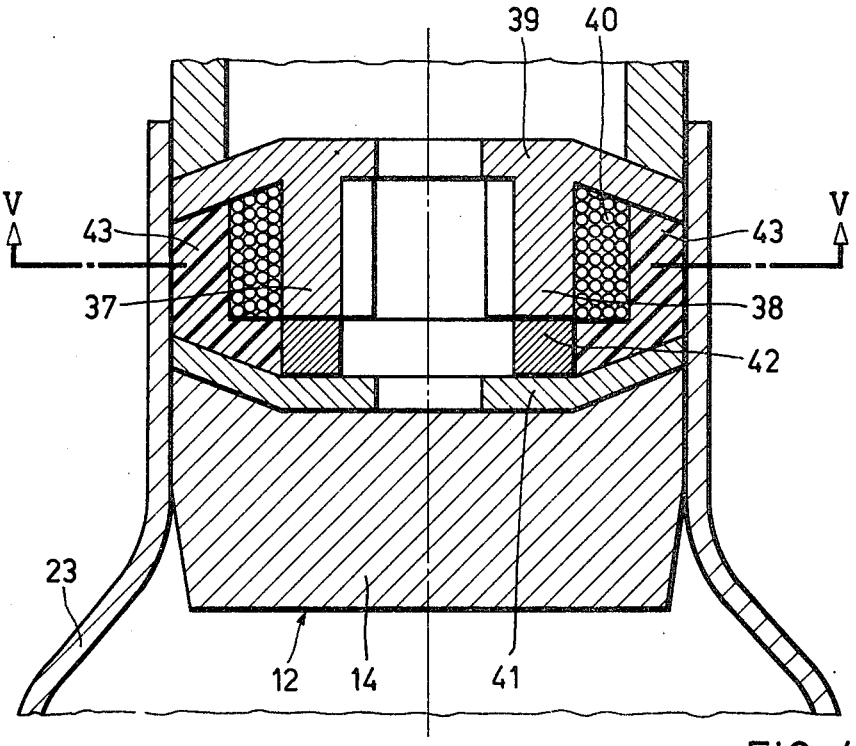
FIG. 4 is a longitudinal sectional view of a third exemplary embodiment of an ignition current generator.
Figure 5:
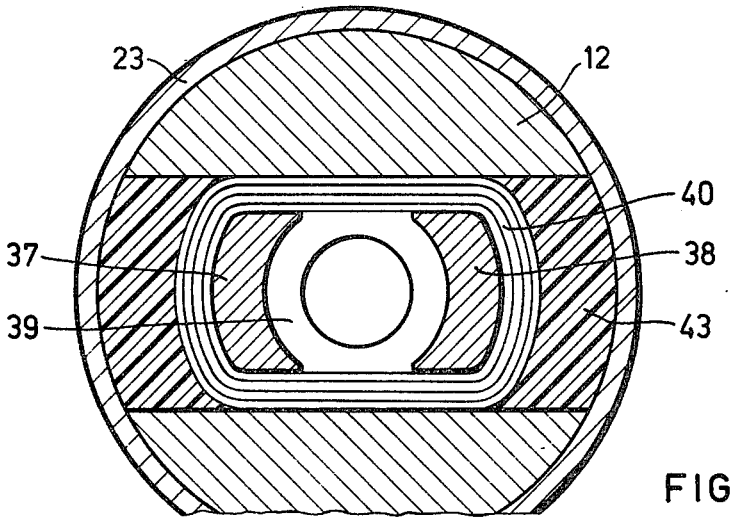
FIG. 5 is a cross-sectional view taken substantially along the line V—V of FIG. 4.

Continuing, and looking to the arrangement shown in FIG. 2, it will be seen that a muzzle brake 33 is attached to the front end of a weapon barrel 32. Since this muzzle brake 33 does not constitute subject matter of the present invention, and its construction and mode of operation may be assumed to be part of the state of the art and not important for understanding the teachings of the present invention, no further discussion thereof is believed to be necessary. At the inner wall of the substantially sleeve-shaped muzzle brake 33 there is arranged the second part of the aforementioned yoke, which second part has been generally designed by reference character 70. This yoke part 70 will be seen to comprise rings or ring members 34 formed of a suitable paramagnetic material, for instance titanium. Now both between and in front of these titanium rings 34 there are secured the rings or ring members 35 formed of ferromagnetic material, for instance steel. The forwardmost ring 35 is threaded into or otherwise appropriately secured at the muzzle brake 33. The width of these rings is preferably somewhat greater than the width of the first part 17 of the yoke containing the soft iron disc 19 (FIG. 1).

The mode of operation of the apparatus described and illustrated in FIGS. 1 and 2 is as follows: When, upon firing the projectile, the projectile body or body member 10 departs from the cartridge sleeve 23, the magnetic field generated by the permanent magnet 18, and which magnetic field is located essentially at the yoke part 17, in the soft iron disc 18 and at the neck of the cartridge sleeve 23, remains shot-circuited by the weapon barrel 32. As soon as the projectile body 10, together with the fuze attached to its rear end, flies mounted upon a yoke or yoke part 57 which is formed by a sleeve 58 and two flanges 59 and 60.

The mode of operation of this modified version of generator is as follows:

Upon passage of the projectile through the weapon barrel 32, there is first opened the magnetic field about the first induction coil 54 by the paramagnetic rings 34 (FIG. 2) and thereafter the magnetic field about the second induction coil 55 is opened by the paramagnetic rings 34. By means of the ferromagnetic rings 35 there is firstly again closed the magnetic field about the first induction coil 54 and thereafter there is closed the magnetic field about the second induction coil 55 by the ferromagnetic rings 35.

In the event that one of these two magnetic fields is open and the other is closed, then the closed magnetic field ensures that the open magnetic field the magnetic flux $\Phi$ drops to null.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for generating an electric ingnition current in a fuze of a projectile intended to be fired out of the barrel of a weapon, comprising:

an induction coil located in the projectile;

a magnet for generating a magnetic field;

a two-part yoke, one part of which is located at the projectile and the other part at the weapon barrel, in order to produce a change in the magnetic flux upon passage of the projectile through the weapon barrel;

the part of the yoke located at the weapon barrel comprises:

a number of ferromagnetic rings; and paramagnetic rings arranged between the ferromagnetic rings;

the part of the yoke located at the projectile comprises:

a substantially cylindrical body member having a substantially disc-shaped flange for the reception of the induction coil; and a soft iron disc;

said magnet comprising a permanent magnet arranged between said substantially cylindrical body member and said soft iron disc;

the axis of the induction coil substantially coinciding with the axis of the projectile; and said ferromagnetic rings and paramagnetic rings are arranged at the end of the weapon barrel.

2. The apparatus as defined in claim 1, further including:

a muzzle brake provided for the weapon barrel;

said ferromagnetic rings and paramagnetic rings being arranged at said muzzle brake of the weapon barrel.

3. The apparatus as defined in claim 1, wherein:

said permanent magnet arranged at the projectile is formed of a cobalt-samarium-alloy.

4. An apparatus for generating an electric ignition current in a fuze of a projectile intended to be fired out of the barrel of a weapon having a barrel mouth, comprising:

an induction coil located in the projectile;

a magnet for generating a magnetic field;

a two-part yoke, one part of which is located at the projectile and the other part at the weapon barrel, in order to produce a change in the magnetic flux upon passage of the projectile through the weapon barrel;

said magnet comprising an electromagnet located at the mouth of the weapon barrel and composed of a number of ferromagnetic rings and paramagnetic rings arranged between the ferromagnetic rings;

the part of the yoke at the weapon barrel comprising a three-arm yoke attached to said ferromagnetic rings;

two electromagnetic coils polarized in opposite directions surrounding at least part of said three-arm yoke;

the axis of the induction coil substantially coninciding with the axis of the projectile.

5. The apparatus as defined in claim 4, wherein:

said number of ferromagnetic rings comprises three ferromagnetic rings connected to one another by two of said paramagnetic rings in the form of sleeves.

6. An apparatus for generating an electric ignition current in a fuze of a projectile intended to be fired out of the barrel of a weapon, comprising:

an induction coil located in the projectile;

a magnet for generating a magnetic field;

a two-part yoke, one part of which is located at the projectile and the other part at the weapon barrel, in order to produce a change in the magnetic flux upon passage of the projectile through the weapon barrel;

the part of the yoke located at the weapon barrel comprises:

a number of ferromagnetic rings; and paramagnetic rings arranged between the ferromagnetic rings;

the part of the yoke located at the projectile comprises:

a substantially cylindrical body member having a substantially disc-shaped flange for the reception of the induction coil; and a soft iron disc;

the axis of the induction coil substantially coinciding with the axis of the projectile; and said ferromagnetic rings and paramagnetic rings are arranged at the end of the weapon barrel.

* * * * *